US006146312A

United States Patent [19]

Schlichter

[11] Patent Number: 6,146,312

[45] Date of Patent: Nov. 14, 2000

[54] BELT FOR IMPROVING POSTURE AND ABDOMINAL MUSCLE TRAINING

[76] Inventor: Allessandra T. Schlichter, 119 Loma Vista, #1, El Segundo, Calif. 90245

[21] Appl. No.: 09/235,347

[22] Filed: Jan. 21, 1999

Related U.S. Application Data

[63] Continuation-in-part of application No. 09/022,876, Feb. 12, 1998.

[51] Int. Cl.[7] ..... G08B 23/00

[52] U.S. Cl. ..... 482/4; 340/573.7

[58] Field of Search ..... 482/1–9, 13, 900–902; 340/571, 572.1, 572.4, 573.7, 407.1, 668

[56] References Cited

U.S. PATENT DOCUMENTS

| | | | |
|---|---|---|---|
| 3,642,276 | 2/1972 | Kropf | 482/1 |
| 4,007,733 | 2/1977 | Celeste et al. | 600/594 |
| 4,392,126 | 7/1983 | Loyola | 340/573 |
| 4,846,462 | 7/1989 | Regnier et al. | 482/1 |
| 4,871,998 | 10/1989 | Chaillou | 340/573 |
| 5,064,192 | 11/1991 | Smith | 482/8 |
| 5,304,984 | 4/1994 | Roldan | 340/573 |
| 5,749,838 | 5/1998 | Kline | 601/71 |

*Primary Examiner*—Glenn E. Richman
*Attorney, Agent, or Firm*—Roy A. Ekstrand

[57] ABSTRACT

A fabric belt includes a pair of segments formed of a non-elastic material coupled to an elastic material segment. The belt includes fabric attachment pads at its end portions to allow it to be secured to a wearer's torso. A sensor is secured across the elastic segment of the belt by a separate tension adjustment segment which is secured to one of the non-elastic segments by a second fabric attachment pad coupling. The sensor includes a motor and battery operatively coupled through a tension responsive switch. The motor rotates an off-center weight to produce a vibratory action when energized. As the user wears the belt, each time the user neglects to maintain proper muscle tightening the vibratory alert is produced by the sensor.

18 Claims, 4 Drawing Sheets

FIG. 3
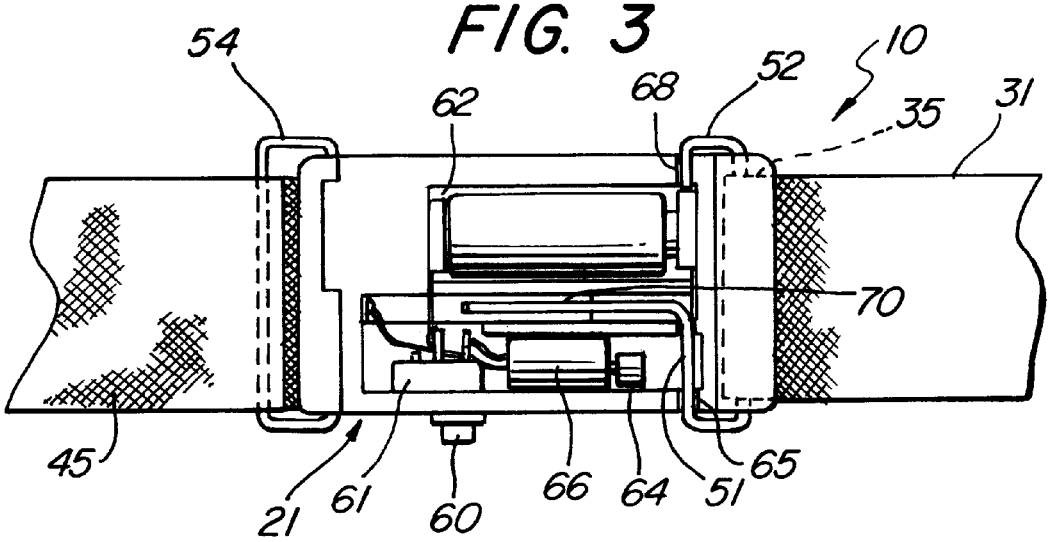
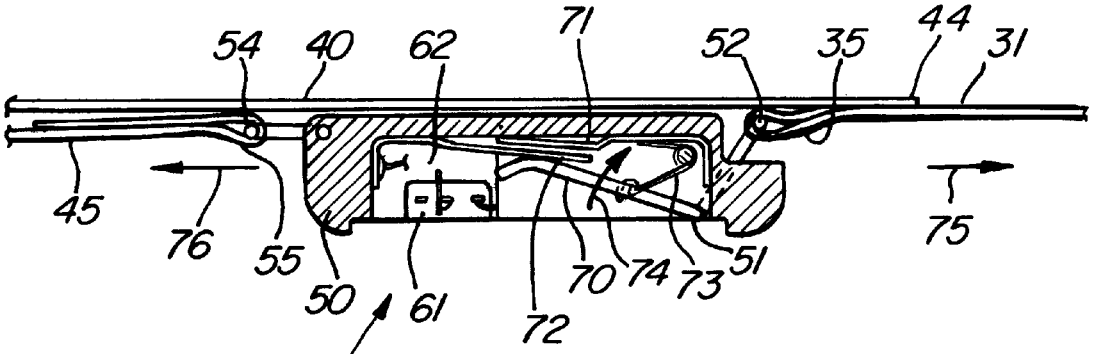
FIG. 4

101
102
103
104
105
110
111
112
113
114
115
120
121
122
125
126
127
128
129
130
131
132
133
135
136
137
139
100

BELT FOR IMPROVING POSTURE AND ABDOMINAL MUSCLE TRAINING

CROSS-REFERENCE TO RELATED APPLICATION

This application is a continuation-in-part of copending application Ser. No. 09/022,876 filed Feb. 12, 1998 on behalf of the Applicant and entitled BELT FOR IMPROVING POSTURE AND ABDOMINAL MUSCLE TRAINING which is incorporated herein by reference.

FIELD OF THE INVENTION

This invention relates generally to health and fitness apparatus and particularly to apparatus for improving posture and the conditioning and strength of abdominal and associated torso muscles.

BACKGROUND OF THE INVENTION

Through the years, humans have exhibited a persistent problem in maintaining health and fitness condition of their bodies as they go about their lives. One serious contributing factor has been the general trend for increased numbers of people to leave agrarian or rural environments in which hard physical labor was typical and to undertake lives instead in sophisticated urban and suburban environments which may generally be characterized as focusing greatly upon non-physical types of skilled labor and substantially reducing the amount of physical manual labor to which such urban and suburban dwellers are subjected. In addition to an overall change in society patterns from rural to urban and suburban, various changes in the eating habits and practices of people have lead to a general decline in the quality of nutrition people consume. For the most part, the average diet of urban and suburban dwellers is often heavy with so-called fast foods or convenience foods which typically contain reduced amounts of quality nutrition and excessive amounts of fats and sugars. As a result, the overall body condition and fitness of people in general has, for the most part, declined.

Poor body condition exhibiting itself as excess weight and reduction of muscle conditioning and strength is a substantial health concern. In addition, the accumulation of excessive weight and general atrophy of muscle condition tends to be regarded as less attractive, of particular concern, both as to general health and as to body appearance, is the tendency in inactive people to develop overly relaxed torso and abdominal muscles as well as excessive weight carried in the abdominal and other torso areas of the body.

It has been found that such poor muscle condition and excess weight in addition to cosmetic and fitness problems may further lead to or be concurrent with general posture problems. It has long been known that persons with exceedingly poor posture may be unduly subjecting their internal organs to potentially harmful stress and may foster other maladies which could easily be avoided had proper posture been maintained.

Despite the extremely undesirable and wide-ranging effects of poor abdominal and torso muscle conditioning and excess weight carried in the abdominal area, the solution for virtually all people is by no means a mystery. Unfortunately, the solution is simple to articulate but has proven exceedingly hard to implement for most people. Simply stated, people may avoid most of the above problems by indulging in moderate exercise, healthy diet and a conscious focus upon maintaining good posture as they go about their day. Experience has shown, however, that few individuals have the commitment or dedication to health to maintain this overall health regimen. As a result, an undue number of people suffer problems associated with health and posture difficulties.

One area of recent interest to medical and health practitioners has been the determination that a substantial benefit in posture and weight control and abdominal and torso muscle conditioning may be accomplished by exercising good posture and making an effort to maintain a tightened muscle condition of the abdominal muscles. The problem, however, is that it is difficult for most people to remember to exercise good posture and to maintain tightened abdominal muscles as they go about a busy day. The need arises therefore to provide a means by which such individuals seeking to improve their health may be reminded to exercise good posture and maintain tightened abdominal muscles for extended periods of time.

Not surprising in view of this need, practitioners in the art have endeavored to provide such "reminder devices". For example, U.S. Pat. No. 4,846,157 issued to Sears sets forth a DEVICE FOR AIDING ABDOMINAL MUSCLE CONTROL having a band for placement about the human anatomy with switch components on the band and displaceable from one another which upon enlargement of the band establish an electrical circuit to a signaling device. An elastic member retracts the band in the absence of anatomical pressure to open the circuit and terminate operation of the signaling device. The signaling device is preferably a vibratory type.

U.S. Pat. No. 4,801,921 issued to Zigenfus sets forth an ABDOMINAL MUSCLE FIRMNESS ALARM having a control unit containing a mechanism for producing a signal in the form of an electrical charge or vibration impulse. A switch is provided for controlling operation and a timer is provided for selecting the interval between transmitted signals. Discs interconnecting the control unit to selectively chosen portions of the wearer's abdominal region are provided. When the wearer senses the signal through the discs, the wearer is reminded to contract the muscles of the abdomen increasing the muscle tone of the latter and serving to restore abdominal flattening.

While the foregoing described prior art devices have attempted to meet the need for reminder apparatus to stimulate the user to contract the abdominal muscles and exercise good posture, thus far such prior art devices have shown themselves to be subject to practical limitations when sought to be implemented for large numbers of users. Most typically, the abdomen connections of U.S. Pat. No. 4,802,921 have been clearly shown to be undesirable and impractical with users reluctant or refusing to use them. The structure set forth in U.S. Pat. No. 4,846,157 provides a vibratory stimulus, however, the device is unduly complex and burdensome for the user. In addition, the device has been shown to be unable to provide a simple and effective tension adjustment mechanism which will allow the user to be comfortable wearing the device. It has been found that users are extremely sensitive to the degree of tightness of a "belt" or other object encircling their abdomens for extended periods of time. No standard tightness preference has been found and the preferences of users varies from those preferring an extremely tight feel to those being intolerant of anything but the loosest feel.

There remains therefore a continuing need in the art for an improved posture and muscle training device which provides the benefits of improved posture and abdominal and torso muscle conditioning.

SUMMARY OF THE INVENTION

Accordingly, it is a general object of the present invention to provide an improved belt for improving posture and abdominal muscle training. It is a more particular object of the present invention to provide an improved belt for improving posture and abdominal muscle training which readily facilitates comfortable wearing by independently adjusting the reminder device actuation level and the tension of the belt felt by the wearer.

In accordance with the present invention, there is provided a belt for improving posture and abdominal muscle training, the belt comprising: a waist belt portion having a resilient expandable segment and a pair of ends joinable to encircle a human torso in an adjustable waist tension; tension sensor having means for producing a vibratory prompt when the tension sensor is subjected to tension exceeding a predetermined magnitude; and means for securing the tension sensor to the waist belt portion spanning the resilient expandable portion so as to exert a tension force to the tension sensor when the resilient expandable portion is stretched, the means for securing including a sensor tension adjuster for establishing an initial tension applied to the tension sensor after the waist tension is adjusted.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a front view of the operative mechanism utilized in the present invention belt for improving posture and abdominal muscle training; and FIG. 4 sets forth a partial section view of the present invention belt for improving posture and abdominal muscle training.

DESCRIPTION OF THE PREFERRED EMBODIMENTS

Figure 1:
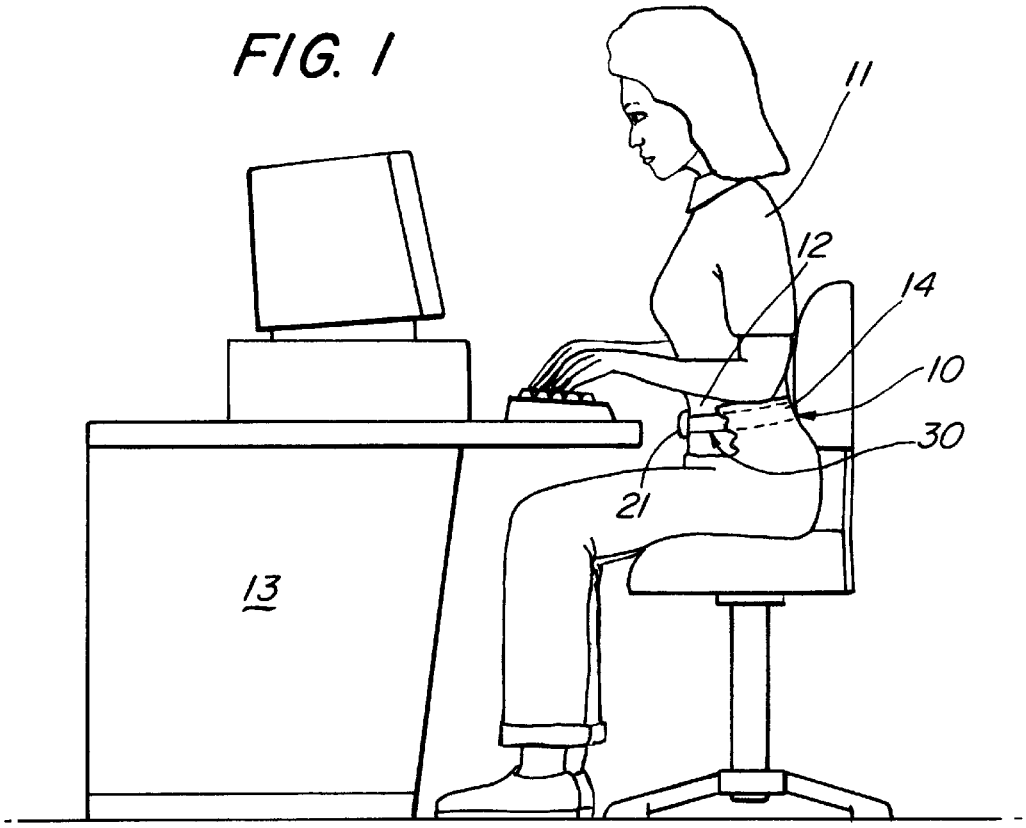
FIG. 1 sets forth a side elevation view of a user seated at a work station wearing a belt for improving posture and abdominal muscle training constructed in accordance with the present invention.

FIG. 1 sets forth a side elevation view of a belt for improving posture and abdominal muscle training constructed in accordance with the present invention and generally referenced by numeral 10 being worn by a typical user 11. User 11 is seated at a work station 13 and is wearing belt 10 about the user's lower torso 12 or waist area. Belt 10 includes a waist belt generally referenced by numeral 30 supporting a sensor 21 both of which are set forth below in greater detail. Suffice it to note here that user 11 has positioned waist belt 30 and sensor 21 beneath the waist band of garment 14. Alternatively, however, it will be understood by those skilled in the art that belt 10 may, if preferred, be worn outside garment 14 without departing from the spirit and scope of the present invention.

In operation, as user 11 is seated at work station 13, the muscles of torso and abdominal area 12 are tightened and drawn inwardly and user 11 assumes a correct sitting posture. Under these circumstances and, as set forth below in greater detail, sensor 21 remains inactive and belt 10 feels much the same as any other belt worn by the user. If, however, user 11 excessively relaxes her abdominal muscles of torso 12, the expansion of user 11's abdominal area extends or stretches waist belt 30 and, by means set forth below in greater detail, causes sensor 21 to react to the expansion of waist belt 30 and produce a vibratory alarm which reminds user 11 to tighten her abdominal muscles and restore sensor 21 to its inoperative state. Thereafter, each time user 11 excessively relaxes abdominal muscles or forgets to maintain abdominal muscles in a tight contraction, a point is reached as abdominal muscles relax at which sensor 21 is again activated producing a vibratory reminder.

In addition to providing reminders for proper tightening of abdominal muscles about torso 12 of user 11, belt 10 is also operative to provide a reminder regarding posture. Thus, should user 11 begin "slumping" rather than sitting upright as shown, waist belt 30 and sensor 21 react to the expansion caused by such slumping about torso 12 and again trigger the vibratory reminder of sensor 21.

Figure 2:
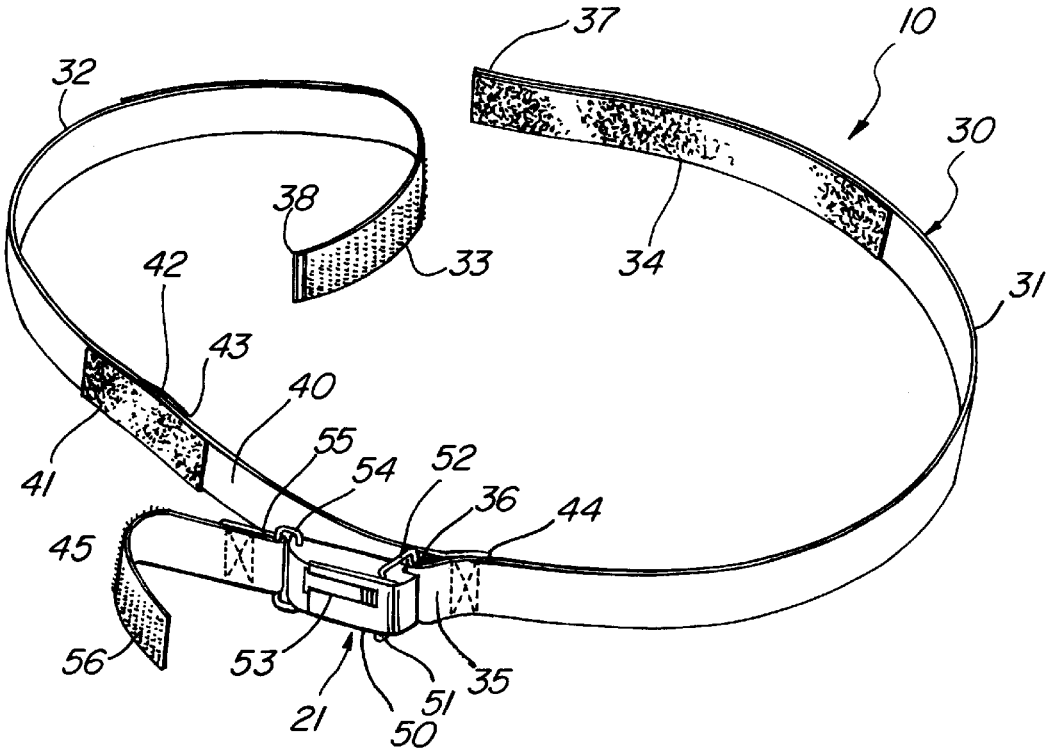
FIG. 2 sets forth a perspective view of the present invention belt for improving posture and abdominal muscle training.

FIG. 2 sets forth a perspective view of the present invention belt for improving posture and abdominal muscle training having a waist belt generally referenced by numeral 30 formed of a segment 31 having an end 37 upon which a fabric attachment pad 34 is secured. Waist belt 30 further includes a segment 32 having an end 38 and a fabric attachment 33 secured to the outer surface near end 38. Fabric attachment pads 33 and 34 are preferably fabricated of the well known hook and loop fabric attachment pads which simply press together for attachment and which may be readily removed to be adjusted or repositioned. In the example of belt 10 shown in FIG. 2, fabric attachment pad 34 forms the loop fabric portion of the attachment pad pair while fabric attachment pad 33 forms the hook fabric attachment portion of the pair. However, it will be apparent to those skilled in the art that pads 33 and 34 may be reversed with pad 34 being the hook fabric and pad 33 being the loop fabric without departing from the spirit and scope of the present invention.

In accordance with an important aspect of the present invention, waist belt 30 further includes a segment 40 extending between segments 31 and 32 having an end 44 joined to segment 31 and an end 42 joined to end 43 of segment 32. In its preferred form, segment 40 is an expandable resilient or elastic material while segments 31 and 31 are substantially nonexpandable cloth fabric material or other suitable material such as high strength canvas or the like. A fabric loop 35 is formed at the end of segment 31 joined to end 44 of segment 40 and defines a space 36 which receives a wire loop 52. A sensor 21 having a housing 50 preferably formed of molded plastic material or the like is secured to loop 52 which passes through a pair of apertures 65 and 66 (seen in FIG. 3) formed in housing 50. The interior end of loop 52 forms an actuator 51 (the structure of which is set forth below in FIG. 3 in greater detail). Suffice it to note here that actuator 51 extends inwardly of housing 50 and provides apparatus which activates sensor 21 in response to angular movement of actuator 51 and loop 52. Housing 50 further supports a battery access door 53 and a wire loop 54. Loop 54 is joined to a fabric loop 55 formed in tension adjustment segment 45. Segment 45 supports a fabric attachment pad 56 on the interior surface thereof. Correspondingly, a fabric attachment pad 41 cooperative with pad 56 is secured to the outer surface of the end portions of segments 40 and 32 covering ends 42 and 43. Once again, it will be understood that fabric attachment pad 41 and fabric attachment pad 56 form a cooperating attachment pad set of the hook and loop variety in their preferred form. It will be further understood that FIG. 2 shows attachment pad 41 being formed of loop material while pad 56 is shown formed of a hook pad material. However, the reverse may be utilized without departing from the spirit and scope of the present invention.

In operation and in accordance with an important aspect of the present invention, the user initially frees tension segment 45 by separating fabric attachment pads 56 and 41 and places waist belt 30 about the user's torso or waist area in the region to be monitored for proper abdominal muscle tightening. The user then secures end 38 against the interior of end 37 of segment 31 using fabric attachment pads 33 and 34. In further accordance with the present invention, the extent of pads 33 and 34 allows substantial variation of size adjustment and the user is readily able to adjust the tightness of waist belt 30 to the user's preference.

Once waist belt 30 is suitably secured and in accordance with an important aspect of the present invention, the user may then adjust the tension applied to sensor 21 by choosing the position of attachment pad 56 upon attachment pad 41. The separate and independent tension adjustment provided by tension adjustment segment 45 which is independent of waist belt 30 provides a unique advantage for the present invention belt in that the user may independently adjust the residual tightness of waist belt 30 and the tension level or expansion point at which sensor 21 is actuated. This greatly enhances the comfort of using and wearing the present invention belt for improving posture and abdominal muscle training. The apparatus within sensor 21 is set forth below in FIGS. 3 and 4 in greater detail. However, suffice it to note here that once belt 40 is positioned upon the wearer, the excessive relaxation of abdominal muscles by the wearer stretches segment 40 which is more elastic and resilient than segment 45. As a result, a stretching action is applied to sensor 21 which causes loop 52 and actuator 51 to be pivoted with respect to housing 50. This pivotal movement of actuator 51 and loop 52 is operative by means set forth below to trigger the vibratory reminder within housing 50. As soon as the wearer retightens the wearer's abdominal muscles, the stress imposed upon segment 40 is reduced and actuator 51 and loop 52 return to their normal position and sensor 21 is deactivated.

FIG. 3 sets forth a partial front view of sensor 21 having battery access door 53 removed. Sensor 21 includes a housing 50 defining an interior cavity 62 within which a conventional battery 63 is secured. A switch 61 is operatively coupled to battery 63 by connecting wires and supports a downwardly extending on/off button 60. The remaining side of switch 61 is coupled to a small electric motor 66 having an output shaft supporting an off-center or off-balance weight 64. Additional connecting wires are provided within interior cavity 62 to complete the electric circuit which includes battery 63, switch 61 and motor 66. A pair of spring contacts 71 and 72 (better seen in FIG. 4) are also supported within interior cavity 62 and are interposed within the battery, switch and motor circuit to provide an additional interrupt for the power coupling to motor 66. Thus, with switch 61 in the on position, and as is better seen in FIG. 4, the separation of spring contacts 71 and 72 maintains an open circuit condition between battery 63 and motor 66 despite switch 61 being in the on position. In further accordance with the present invention, actuator 51 extending inwardly of housing 50 from wire loop 52 includes an arm 70 which is positioned overlying spring contact 72. Actuator 51 and wire loop 52 are pivotally supported within housing 51 by apertures 65 and 68 respectively.

FIG. 4 sets forth a section view of sensor 21 having battery access door 53 removed from housing 50. As described above, segment 31 of waist belt 30 forms a fabric loop 35 within which a wire loop 52 is received. Segment 40 of waist belt 30 defines an end 44 which is joined to segment 31 at fabric loop 35. As is also described above, segment 40 is preferably formed of an elastic resilient material, the remaining end of which is secured to segment 31 of waist belt 30 (seen in FIG. 2). A tension adjustment segment 45 defines a fabric loop 55 which receives a wire loop 54 securing housing 50 of sensor 51 to tension adjustment segment 45. Housing 50 defines an interior cavity 62 within which a switch 61 is supported. Also supported within interior cavity 62 is a pair of spring contacts 71 and 72 having a resilient spring steel material and having respective shapes which urge contacts 71 and 72 apart to the separated position shown in FIG. 4. Wire loop 52 and actuator 51 are pivotally supported upon housing 50. Actuator 51 further includes an inwardly extending arm 70 which overlies spring contact 72. A return spring 73 is coupled between arm 70 and housing 50 to provide a return force which urges arm 70 outwardly from interior cavity 62 to the position shown in FIG. 4.

In the configuration shown in FIG. 4, sensor 21 and the supporting segments of waist belt 30 are shown in the relaxed position corresponding to the circumstances when the user is maintaining proper tightening of abdominal muscles and proper posture to avoid slumping. In the event the user neglects to maintain such abdominal muscle tightening, an expansion of the abdominal area of the torso occurs (seen in FIG. 1) which causes segment 40 to be placed in increased tension and, as a result, stretches segment 40 and imposing a stretching tension upon sensor 21 as indicated by arrows 75 and 76. As segment 40 stretches, the movement of segment 31 in the direction indicated by arrow 75 pivots actuator 51 about apertures 65 and 68 (seen in FIG. 3) of housing 50. The pivoting of actuator 51 in turn pivots arm 70 inwardly overcoming the force of spring 73 moving arm 70 in the direction indicated by arrow 74. As arm 70 pivots inwardly, the separating spring force of contacts 71 and 72 is overcome bringing spring contact 72 into electrical contact with spring contact 71 completing the above-described battery power circuit to motor 66. Once motor 66 (seen in FIG. 3) is energized by battery 63, the off-center character of weight 64 causes a vibratory energy to be produced.

Returning to FIG. 4, the vibratory energy thus produced when contacts 71 and 72 touch, provides a reminder vibration sensed by the wearer and causes the wearer to respond by retightening abdominal muscles. Once the wearer does so, the tension imposed upon segment 40 is again reduced allowing segment 40 to relax and removing the drawing tension applied to actuator 51. Accordingly, the spring force or spring 73 causes arm 70 to pivot outwardly allowing spring contact 72 to separate from spring contact 71 thereby interrupting the action of motor 66. At this point, sensor 21 is again inactive and the user is free of any vibratory prompting. It will be noted that the user may deactivate sensor 21 to provide a rest period by simply switching switch 61 to the off position. With switch 61 in the off position, the user is free to relax abdominal muscles and notwithstanding the stretching of segment 40 which results and the touching of contact 71 and 72, no electrical energy is applied to motor 66 (seen in FIG. 3) and no vibratory takes place.

Figure 5:
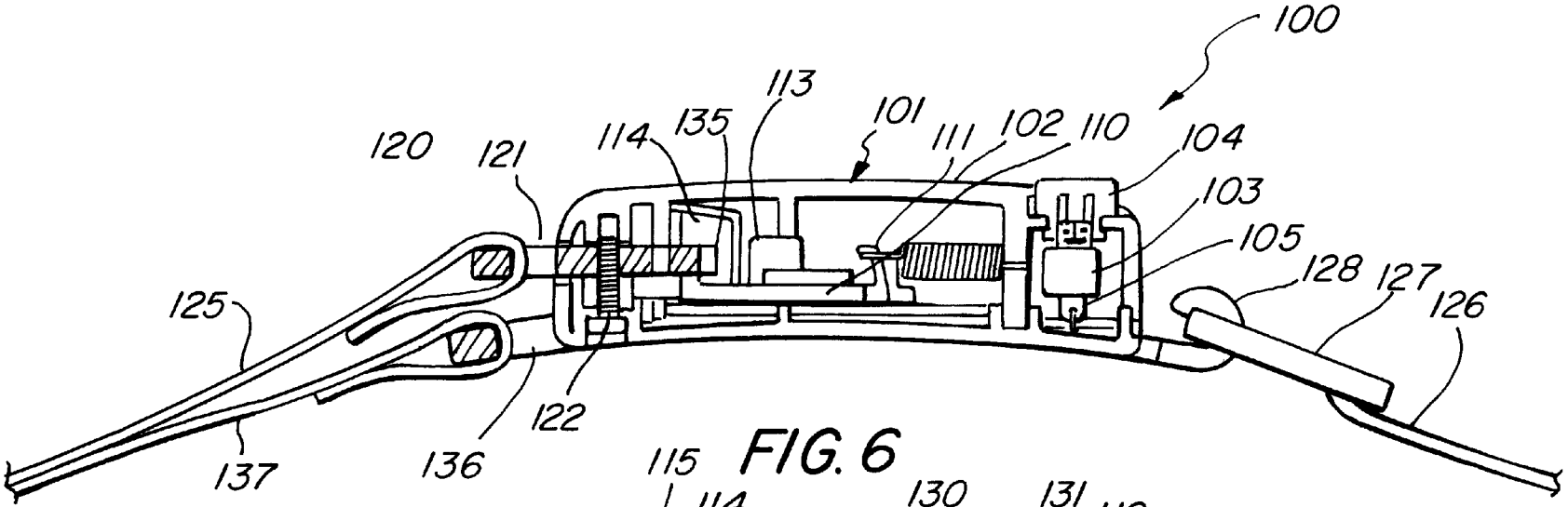
FIG. 5 sets forth a section view of an alternate embodiment of the present invention.

FIG. 5 sets forth a section view of an alternate embodiment of the present invention utilizing a similar belt arrangement to that set forth above and thereby providing independent tension adjustment for the sensing action and the waist tension exerted upon the wearer. Thus, belts 137 and 126 provide waist attachment about the torso of the wearer and are set to the desired tension in the manner set forth above in FIG. 2. In further correspondence to the above-described embodiment, belt 125 is independently tension adjusted to suit the tension preference required to trigger the vibrating action of sensor 101. FIG. 5 shows the section view of sensor 101 in the relaxed or non-triggered position.

More specifically, belt 100 supports a sensor 101 having a housing 102. Housing 102 is coupled to belt 126 on one side by a hook 128 and a coupler 127. Housing 101 is further coupled to a belt 137 by a coupler 136. These attachments are firm attachments and do not move with respect to housing 102. Housing 102 further supports a switch 103 having a tab 105 and a plurality of electrical terminals 104.

Sensor 101 further includes a slide 110 slidably supported within the interior of housing 102 and having a post 111 formed therein. Post 111 is coupled to one end of a spring 112, the remaining end of which is fixedly secured within housing 102. Slide 110 further includes a cam post 113 which extends upwardly from slide 110. Slide 110 is further joined to a slide coupler 120 which extends inwardly into housing 102 and which is joined to slide 110 in a fixed attachment. Slide coupler 120 defines a slot 121 which receives a pin 122. The latter is fixedly supported within housing 102. Slide coupler 120 is joined to a belt 125 which provides tension adjustment in a similar manner to tension adjustment segment 45 shown in FIG. 2 above. The presence of pin 122 within slot 121 allows slide coupler 120 to be slidably movable into and out from the interior of housing 102 along with slide 110. Spring 112 opposes outward movement of slide 110 and slide coupler 120 tending to urge slide 110 to the right within the drawing. Thus, tension exerted upon belt 125 sufficient to overcome the force of spring 112 draws slide 110 to the left in the figure.

Sensor 101 further includes a spring contact 114 which extends across the travel path of cam post 113 and beyond a battery contact 135.

In the relaxed position shown, the tension upon belt 125 is insufficient to overcome the force of spring 112. As a result, slide 10 and coupler 120 are positioned toward the right side of their travel paths in the figure. Correspondingly, cam post 113 is moved form contact with spring contact 114. Spring contact 114 in turn is spaced from battery contact 135. As a result, no power coupling takes place and sensor 101 is basically inactive.

Figure 6:
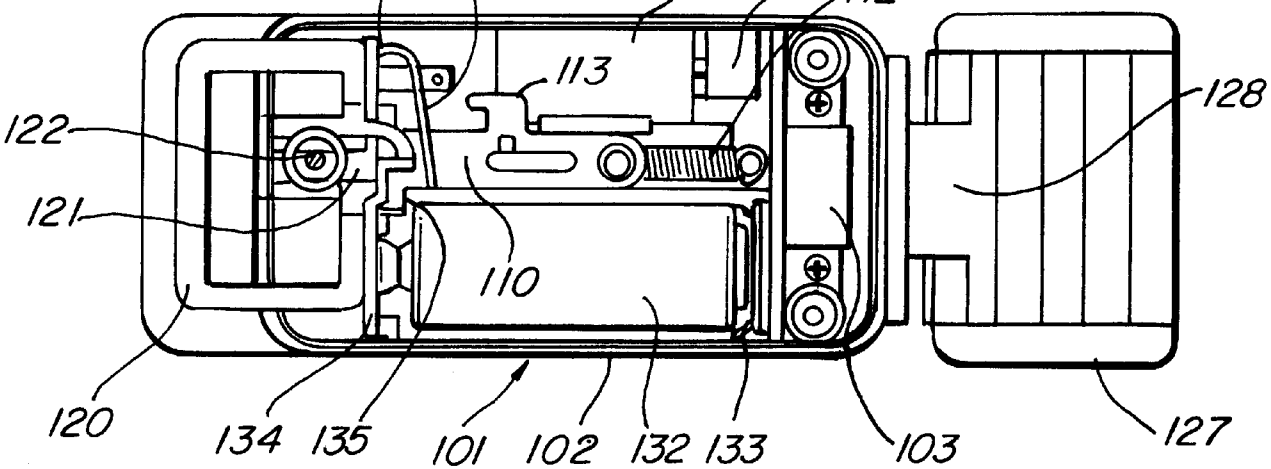
FIG. 6 sets forth a top view thereof with its cover removed.

FIG. 6 sets forth a top view of sensor 101 having belts 125, 126 and 137 omitted. In addition, FIG. 6 shows sensor 101 having the top cover removed to better show the internal apparatus thereof.

More specifically, sensor 101 includes a housing 102 within which a conventional battery 132 having terminals 133 and 134 electrically coupled thereto are supported. Sensor 101 further includes a switch 103 and a motor 130. Motor 130 supports an eccentric weight 131 such that energizing of motor 130 rotates eccentric weight 131 imparting a vibratory energy to sensor 101. While not seen in the figure, it will be understood that terminals 133 and 134 together with battery 132 and switch 103 cooperate to provide energizing of motor 130 once spring contact 114 touches contact 135.

Sensor 101 further includes a slide 110 slidably movable within the interior of housing 102 and having a post 111 coupled to a spring 112. Slide 110 further supports an upwardly extending post cam 113. A coupler 120 is joined to slide 110 and defines an elongated slot 121. A pin 122 is supported within housing 102 and is received within slot 121. In this manner, the sliding motion of slide 110 and coupler 120 is limited to a left to right motion in the figure.

A spring contact 114 is secured to a post 115 and extends inwardly beyond contact 135.

In the relaxed position shown in FIG. 6, the position of spring contact 114 is also relaxed and extends inwardly from contact 135. As a result, no electrical connection is made to motor 130. Thus, FIG. 6 shows sensor 101 in a relaxed position.

Figures 7, 8:
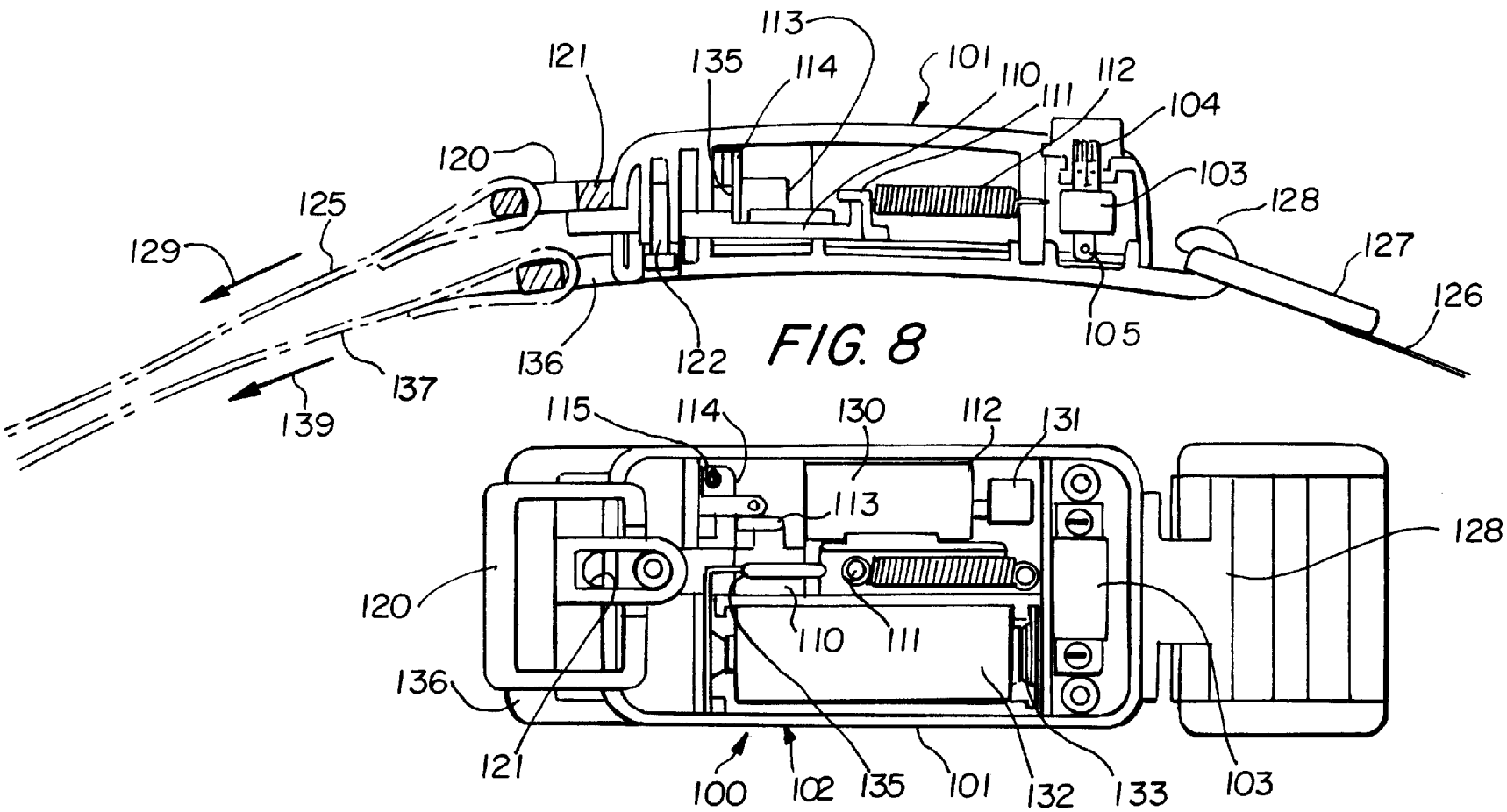
FIG. 7 sets forth a section view of an alternate embodiment of the present invention.
FIG. 8 sets forth a top view thereof with its cover removed.

FIG. 7 sets forth a section view of sensor 101 in the triggered or activated configuration. Thus, for the most part, FIG. 7 is similar to FIG. 5 with the difference being the displacement of slide coupler 120 and slide 110 to the left in the figure due to the increase of tension for belt 125.

More specifically, belt 100 supports a sensor 101 having a housing 102. Housing 102 is coupled to belt 126 on one side by a hook 128 and a coupler 127. Housing 101 is further coupled to a belt 137 by a coupler 136. These attachments are firm attachments and do not move with respect to housing 102. Housing 102 further supports a switch 103 having a tab 105 and a plurality of electrical terminals 104.

Sensor 101 further includes a slide 110 slidably supported within the interior of housing 102 and having a post 111 formed therein. Post 111 is coupled to one end of a spring 112, the remaining end of which is fixedly secured within housing 102. Slide 110 further includes a cam post 113 which extends upwardly from slide 110. Slide 110 is further joined to a slide coupler 120 which extends inwardly into housing 102 and which is joined to slide 110 in a fixed attachment. Slide coupler 120 defines a slot 121 which receives a pin 122. The latter is fixedly supported within housing 102. Slide coupler 120 is joined to a belt 125 which provides tension adjustment in a similar manner to tension adjustment segment 45 shown in FIG. 2 above. The presence of pin 122 within slot 121 allows slide coupler 120 to be slidably movable into and out from the interior of housing 102 along with slide 110. Spring 112 opposes outward movement of slide 110 and slide coupler 120 tending to urge slide 110 to the right within the drawing. Thus, tension exerted upon belt 125 sufficient to overcome the force of spring 112 draws slide 110 to the left in the figure.

Sensor 101 further includes a spring contact 114 which extends across the travel path of cam post 113 and beyond a battery contact 135.

Thus, sufficient tension upon belt 125 in the direction indicated by arrow 129 overcomes the force of spring 112 drawing slide 110 together with cam post 113 to the left in the figure. As cam post 113 is forced against spring contact 114, the spring force is overcome and spring contact 114 is driven against contact 135. In this manner, electrical connection is provided between post 115 (seen in FIG. 8) and contact 135 completing the circuit for motor 130 (seen in FIG. 8) so long as switch 103 is in the on position. Should switch 103 be in the off position, of course, the electrical circuit providing power to the motor remains interrupted. Once again, it must be emphasized that the tension in belts 137 and 125 are separately adjustable to provide independent tension adjustment.

FIG. 8 sets forth a top view of sensor 101 similar to that shown in FIG. 6 with the difference being the above-described slide movement to activate the vibratory mechanism within the device.

More specifically, sensor 101 includes a housing 102 within which a conventional battery 132 having terminals 133 and 134 electrically coupled thereto are supported. Sensor 101 further includes a switch 103 and a motor 130. Motor 130 supports an eccentric weight 131 such that energizing of motor 130 rotates eccentric weight 131 imparting a vibratory energy to sensor 101. While not seen in the figure, it will be understood that terminals 133 and 134 together with battery 132 and switch 103 cooperate to provide energizing of motor 130 once spring contact 114 touches contact 135.

Sensor 101 further includes a slide 110 slidably movable within the interior of housing 102 and having a post 111 coupled to a spring 112. Slide 110 further supports an upwardly extending post cam 113. A coupler 120 is joined to slide 110 and defines an elongated slot 121. A pin 122 is supported within housing 102 and is received within slot 121. In this manner, the sliding motion of slide 110 and coupler 120 is limited to a left to right motion in the figure.

A spring contact 114 is secured to a post 115 and extends inwardly beyond contact 135.

Thus, as can be seen, the movement of slide 110 to the left in the figure as tension is applied to coupler 120 sufficient to overcome the force of spring 112 moves cam post 113 against contact spring 114 and bending the contact spring against contact 135. As a result, an electrical connection is made between terminal 134 via contact 135 and post 115. While not seen in the drawing, it will be understood that electrical connection using conventional means (not shown) is provided between post 115 and spring contact 114 to couple power to motor 130. The position of slide 110 and the maintenance of the electrical connection thus made is maintained so long as sufficient tension is applied to coupler 120 to overcome spring 112. When the tension is reduced, such as by the user with drawing or tightening their abdomen, the spring force of spring 112 restores slide 110 to the relaxed position shown in FIGS. 5 and 6.

What has been shown is an improved belt for improving posture and abdominal muscle training in which a vibratory sensor prompts the wearer to maintain proper abdominal muscle tightening or tensioning. The improved belt may be independently adjusted for belt tension upon the wearer's waist and tension required to trigger the vibratory sensor. Thus, wearers are able to accommodate individual preferences as to belt tightness while maintaining their preferential adjustment of sensor tension trigger level.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A belt for improving posture and abdominal muscle training, said belt comprising:

a waist belt portion having a resilient expandable segment and a pair of ends joinable to encircle a human torso in an adjustable waist tension;

tension sensor having means for producing a vibratory prompt when said tension sensor is subjected to tension exceeding a predetermined magnitude; and means for securing said tension sensor to said waist belt portion spanning said resilient expandable portion so as to exert a tension force to said tension sensor when said resilient expandable portion is stretched, said means for securing including a sensor tension adjuster for establishing an initial tension applied to said tension sensor after said waist tension is adjusted.

2. The belt set forth in claim 1 wherein said means for securing includes:

a first belt loop securing one portion of said tension sensor to said waist belt beyond said resilient expandable segment at one end thereof;

a tension adjuster segment having a second loop secured to said tension sensor and having a free end supporting a first fabric attachment pad; and a second fabric attachment pad secured to said waist belt proximate the remaining end of said resilient expandable segment, said first and second fabric attachment pads forming a hook and loop attachment pair.

3. The belt set forth in claim 2 wherein said tension sensor includes:

a housing defining an interior cavity;

a battery within said interior cavity;

a motor coupled to said battery having an output shaft and unbalanced weight thereon; and a tension responsive switch activating said motor in response to a tension force exceeding a predetermined magnitude.

4. The belt set forth in claim 3 wherein said tension responsive switch includes a pair of normally open spring contacts and an actuator pivotally supported by said housing and having an arm forcing said spring contacts together in response to tension.

5. The belt set forth in claim 4 wherein said ends of said waist belt portion support cooperating hook and loop fabric attachment pads.

6. The belt set forth in claim 5 wherein said tension sensor includes an on/off switch interposed between said motor and said battery.

7. The belt set forth in claim 6 wherein said tension sensor includes a return spring coupled to said arm urging said arm away from said spring contacts.

8. The belt set forth in claim 1 wherein said tension sensor includes:

a housing defining an interior cavity;

a battery within said interior cavity;

a motor coupled to said battery having an output shaft and unbalanced weight thereon; and a tension responsive switch activating said motor in response to a tension force exceeding a predetermined magnitude.

9. The belt set forth in claim 8 wherein said means for securing includes:

a first belt loop securing one portion of said tension sensor to said waist belt beyond said resilient expandable segment at one end thereof;

a tension adjuster segment having a second loop secured to said tension sensor and having a free end supporting a first fabric attachment pad; and a second fabric attachment pad secured to said waist belt proximate the remaining end of said resilient expandable segment, said first and second fabric attachment pads forming a hook and loop attachment pair.

10. The belt set forth in claim 9 wherein said tension responsive switch includes a pair of normally open spring contacts and an actuator pivotally supported by said housing and having an arm forcing said spring contacts together in response to tension.

11. The belt set forth in claim 10 wherein said ends of said waist belt portion support cooperating hook and loop fabric attachment pads.

12. The belt set forth in claim 11 wherein said tension sensor includes an on/off switch interposed between said motor and said battery.

13. The belt set forth in claim 12 wherein said tension sensor includes a return spring coupled to said arm urging said arm away from said spring contacts.

14. A belt for improving posture and abdominal muscle training, said belt comprising:

a first belt segment having first and second ends;

a second belt segment having third and fourth ends;

a third belt segment formed of a resilient material and having fifth and sixth ends joined to said fourth and second ends respectively;

a tension sensor having a tension actuator coupled to said second end and an attachment;

a fourth belt segment having a seventh end secured to said attachment and an eighth end;

a first pair of fabric attachment pads secured to said first end and said third end; and a second pair of fabric attachment pads secured to said eighth end and said fourth end.

15. The belt set forth in claim 14 wherein said first and second belt segments are formed of a generally less resilient material than that of said third segment.

16. The belt set forth in claim 15 wherein said fourth belt segment is substantially less resilient than said third belt segment.

17. The belt set forth in claim 16 wherein said tension sensor includes:

a housing defining an interior cavity;

a battery within said interior cavity;

a motor coupled to said battery having an output shaft and unbalanced weight thereon; and a tension responsive switch activating said motor in response to a tension force exceeding a predetermined magnitude.

18. The belt set forth in claim 17 wherein said tension responsive switch includes a pair of normally open spring contacts and an actuator pivotally supported by said housing and having an arm forcing said spring contacts together in response to tension.

* * * * *